US009381769B2

(12) United States Patent
Flynn

(10) Patent No.: US 9,381,769 B2
(45) Date of Patent: Jul. 5, 2016

(54) PAINT STORAGE AND DISPENSING KIT

(71) Applicant: Michael P. Flynn, Rancho Santa Fe, CA (US)

(72) Inventor: Michael P. Flynn, Rancho Santa Fe, CA (US)

(73) Assignee: Myrna Flynn, Huntington Beach, CA (US)

( * ) Notice: Subject to any disclaimer, the term of this patent is extended or adjusted under 35 U.S.C. 154(b) by 577 days.

(21) Appl. No.: 13/901,991

(22) Filed: May 24, 2013

(65) Prior Publication Data

US 2014/0345746 A1 Nov. 27, 2014

(51) Int. Cl.

| | |
|---|---|
| ***B44D 2/00*** | (2006.01) |
| ***B67D 7/06*** | (2010.01) |
| ***B67C 11/02*** | (2006.01) |
| ***B44D 3/00*** | (2006.01) |
| *B05C 17/10* | (2006.01) |

(52) U.S. Cl.

CPC *B44D 2/002* (2013.01); *B44D 3/00* (2013.01); *B67C 11/02* (2013.01); *B67D 7/06* (2013.01); *B05C 17/10* (2013.01)

(58) Field of Classification Search

CPC ..... B44D 2/002; B44D 3/00; B44D 3/12
USPC ..... 141/18, 20.5, 247, 331–345, 106; 206/229, 223

See application file for complete search history.

(56) References Cited

U.S. PATENT DOCUMENTS

| | | | | | |
|---|---|---|---|---|---|
| 589,659 | A * | 9/1897 | Krack | B65D 1/02 | 141/331 |
| 790,080 | A * | 5/1905 | Seavy | B65D 1/02 | 141/331 |
| 4,583,668 | A * | 4/1986 | Maynard, Jr. | B65D 25/48 | 141/367 |
| 5,871,118 | A * | 2/1999 | Franzese | A47G 19/2272 | 220/713 |
| 6,209,595 | B1 * | 4/2001 | Granath | B65D 1/18 | 141/331 |
| 6,439,381 | B1 * | 8/2002 | Alvarez | B44D 3/04 | 206/223 |
| 2008/0105328 | A1 * | 5/2008 | Desmond | A45C 3/00 | 141/2 |

* cited by examiner

*Primary Examiner* — Mark A Laurenz
*Assistant Examiner* — Timothy P Kelly
(74) *Attorney, Agent, or Firm* — Ali Shalchi

(57) ABSTRACT

A paint storage kit is provided for storing and dispensing paint in a manner that minimizes mess and loss of paint. The paint storage kit includes a larger storage container, a funnel, and a smaller touch-up container. The storage container includes a removable, flexible pour spout that reversibly connects with the opening of the storage container and facilitates clean transfer of paint into the touch-up container(s) or alternate location. The touch-up container includes a plastic tube, storage cap, and applicator pad. Paint is transferred to the storage container where it stored. The paint can then be transferred to one or more touch-up containers. The touch-up containers can apply small amounts of paint directly via an applicator pad affixed to the top of the touch-up container.

7 Claims, 8 Drawing Sheets

PAINT STORAGE AND DISPENSING KIT

RELATED U.S. APPLICATION DATA

This application claims priority to Provisional Application No. 61/655,495, filed Jun. 5, 2012.

FIELD OF THE INVENTION

The present invention relates to devices for storing and dispensing paint.

BACKGROUND OF THE INVENTION

Paint is a common material used in residential, commercial and industrial settings. In particular, residential homeowners commonly purchase cans of paint for do-it-yourself projects. However, the transfer of paint from the native paint cans is difficult and messy, as is the return of unused paint to the can and subsequent usage. Paint comes in a standard metal can with a large lid that is poorly suited for pouring. Use of standard painting tools results in wasted paint and a messy process. Thus, there is a need in the art for a more effective means of storing and dispensing paint. In particular, there is a need for more specialized containers that can more effectively store and transfer paint.

SUMMARY OF THE INVENTION

A paint storage kit embodies a method of storing and applying paint via a dedicated container system. The kit is comprised of one or more larger primary storage containers, one or more secondary or touch-up containers, and a funnel. The containers are substantially air-tight during storage phases. The large storage containers include a flexible pour spout attached to the opening of each container to facilitate clean transfer of stored paint into the smaller touch-up containers. The paint transfer occurs in conjunction with a dedicated funnel. The system is initially implemented as a method of cleanup and storage after a first-time paint application from store-bought cans, whereby leftover paint from the can and/or paint tray can be emptied into a large container, or plurality of large containers, for indefinite storage. Alternatively, the newly stored paint could be distributed into one smaller touch-up containers, or plurality of said containers, for the purpose of applying small amounts of paint in the event there is a desire to revisit the painted area. For such touch-up applications, an applicator pad can be optionally attached to the top of the touch-up container, providing a hand-held painting functionality to the container. The applicator pad can be durable or disposable. In the disposable embodiment, the applicator pad is removed after use and replaced with a screw-cap for storage.

DETAILED DESCRIPTION

The present invention provides a paint storage kit that that provides more effective apparatus and method for handling and storing paint. This method is defined by a two-step approach that allows the user to systematically store and then re-use new or leftover paint at his/her discretion with the aid of a dedicated kit comprising large storage containers having a pour spout, smaller touch-up containers, and a paint funnel. The touch-up containers optionally include an applicator pad to allow smaller amounts of paint to be applied directly from the touch-up container. The kit is advantageous for the common situation in which the paint it utilized over an extended time frame and/or repeated applications. Because the transfer and storage of paint becomes cleaner, easier and more efficient with the kit of the present invention, the user is able to re-apply stored paint over a prolonged period of time.

Figure 1:
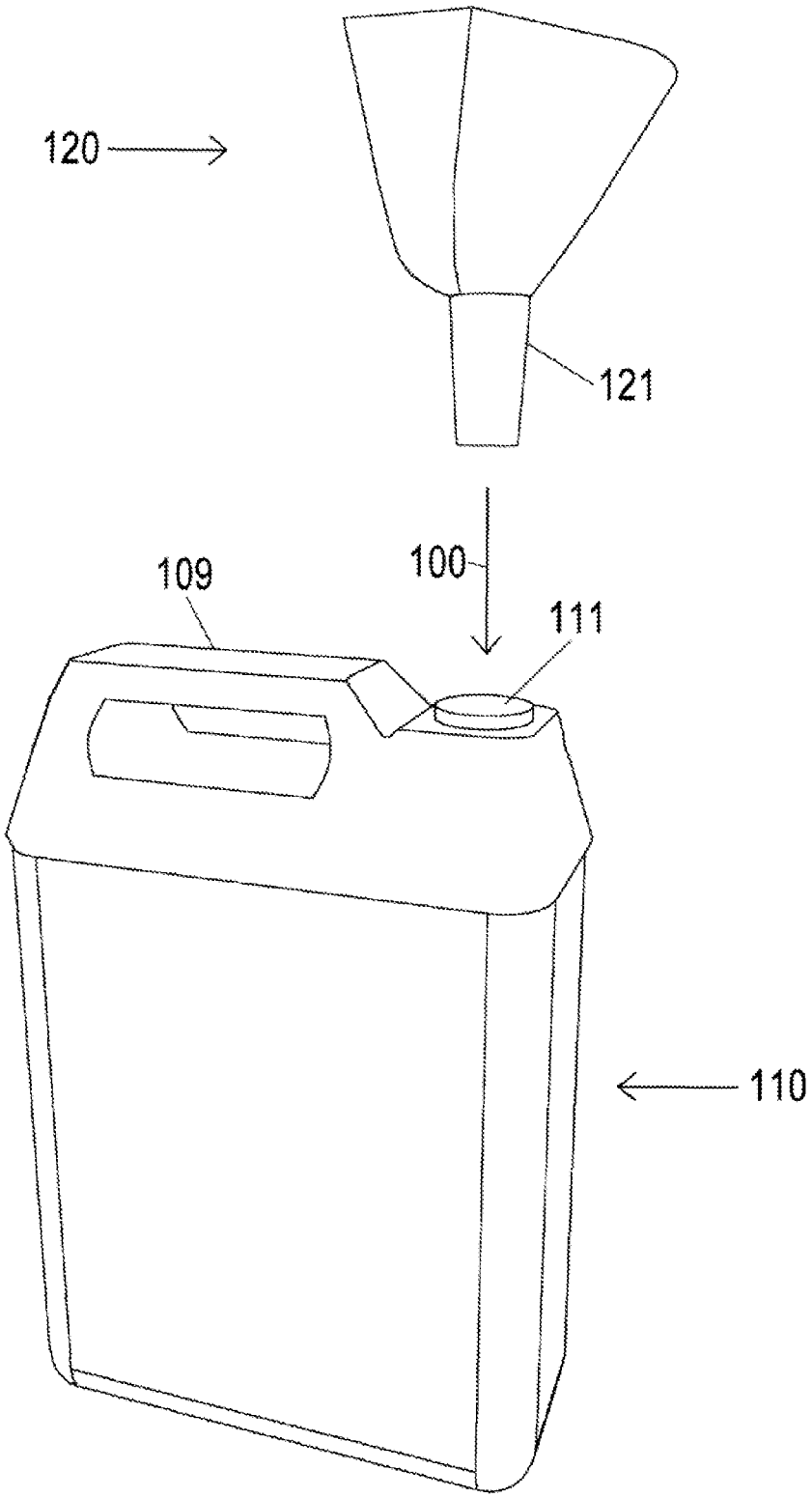
FIG. 1 illustrates the primary storage container and the paint funnel.
Figure 2:
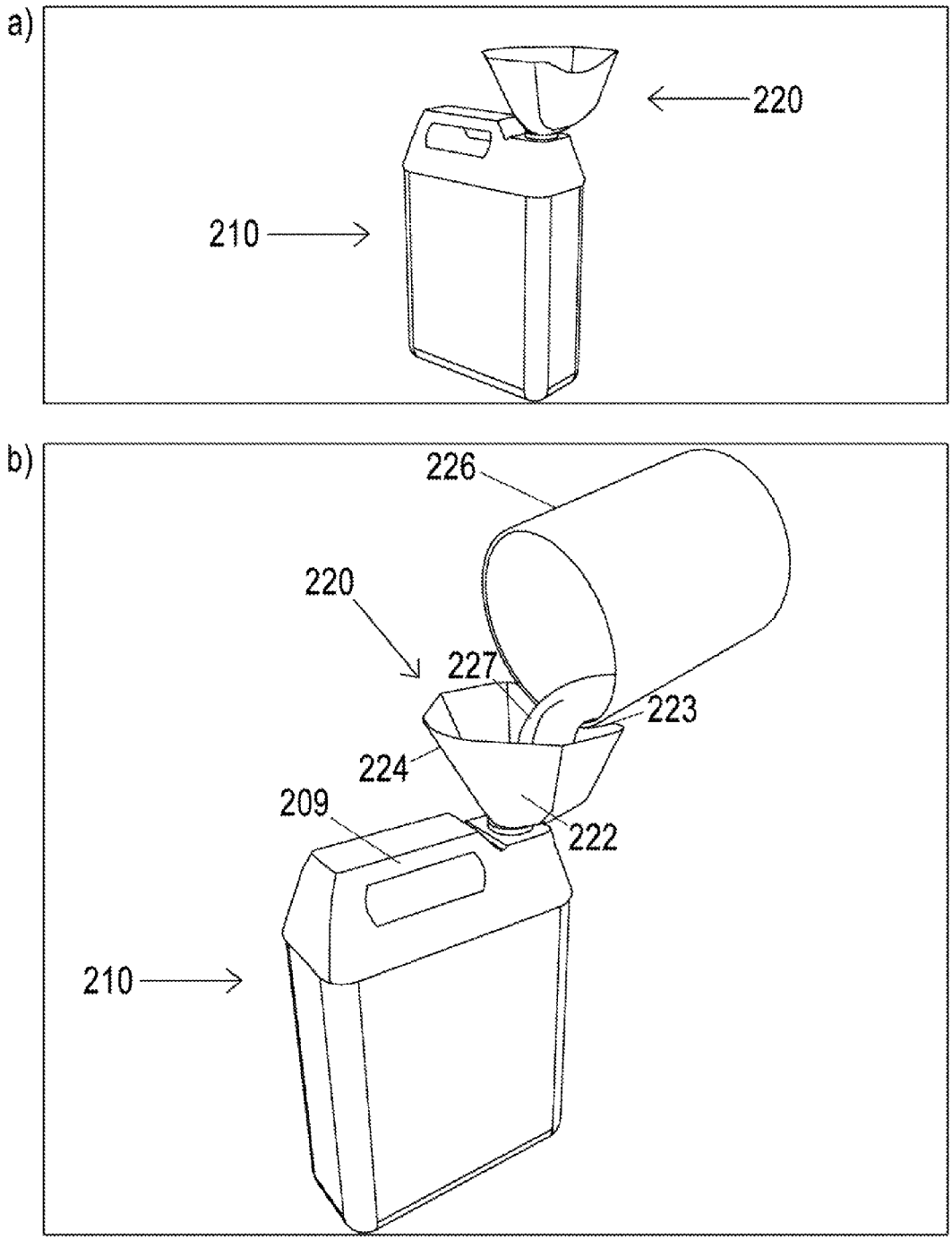
FIG. 2A illustrates the paint funnel engaged with the primary storage container.
FIG. 2B illustrates paint being poured into the storage container via the funnel.
Figure 7:
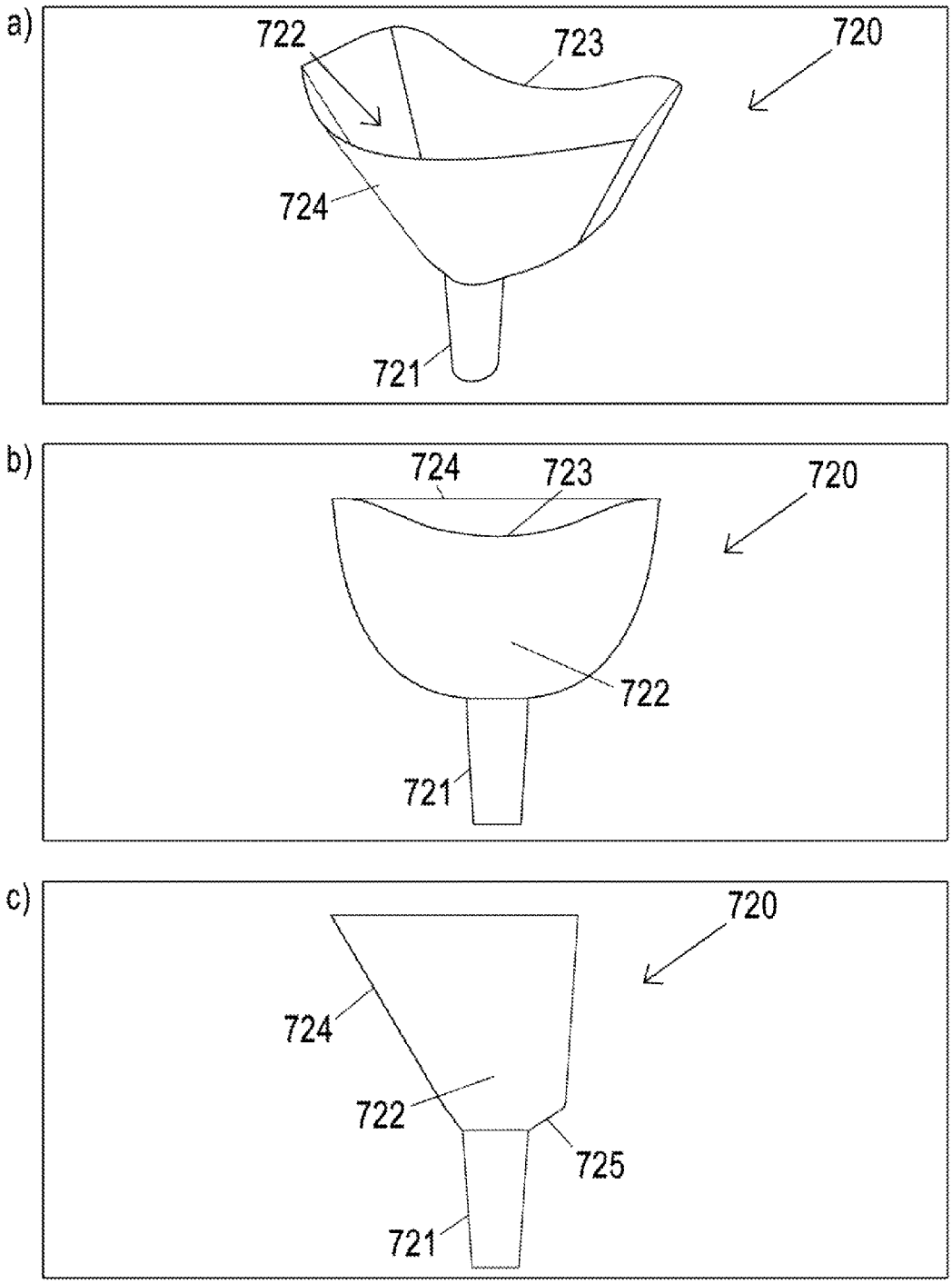
FIGS. 7A-C illustrate different views of the paint funnel.

FIG. 1 illustrates a perspective view of the paint storage container 110 and paint funnel 120 being prepared for initial paint storage. Paint funnel 120 includes a stem 121 and is described more fully in the discussion of FIG. 7. The storage container includes a handle 109 and opening 111. The large storage container 110 is placed on a level surface and the cap is removed to expose the container opening 111. The storage container 110 is configured to receive the paint funnel 120 as indicated by arrow 100. The paint funnel stem 121 is inserted into the opening 111 of the storage container and rests on region of the storage container around the opening 111 as shown in FIG. 2.

FIGS. 2A and 2B illustrate perspective views of an initial paint transfer into the paint storage container 210. FIG. 2A shows the paint funnel 220 inserted into, and resting on, storage container 210. The paint funnel 220 rests atop the large container 210 in a stable manner that facilitates the pouring of paint into the funnel without undesired shaking or movement of the funnel which can result in spilled paint. FIG. 2B illustrates transfer of paint from a standard store-bought can 226 to the large storage container 210. The paint funnel comprises funnel chamber 222, convex side 223, and concave side 224. To initiate this transfer, a user raises the store-bought can 226 above the convex side 223 of the paint funnel 220 and tilts it downward to pour the paint 227 into the funnel chamber 222. The shape of convex side 223 facilitates easier paint transfer because the convex shape contours to the shape of the paint can and allows the paint can to be closer to the funnel chamber 222 during paint transfer. The paint 227 flows through the funnel stem 121 (not shown) and into the storage container 210. As described further in the discussion of FIG. 7, the paint funnel is particularly configured to accept large amounts of viscous fluid which is transferred through the funnel stem at a sufficient flow rate.

Figure 3:
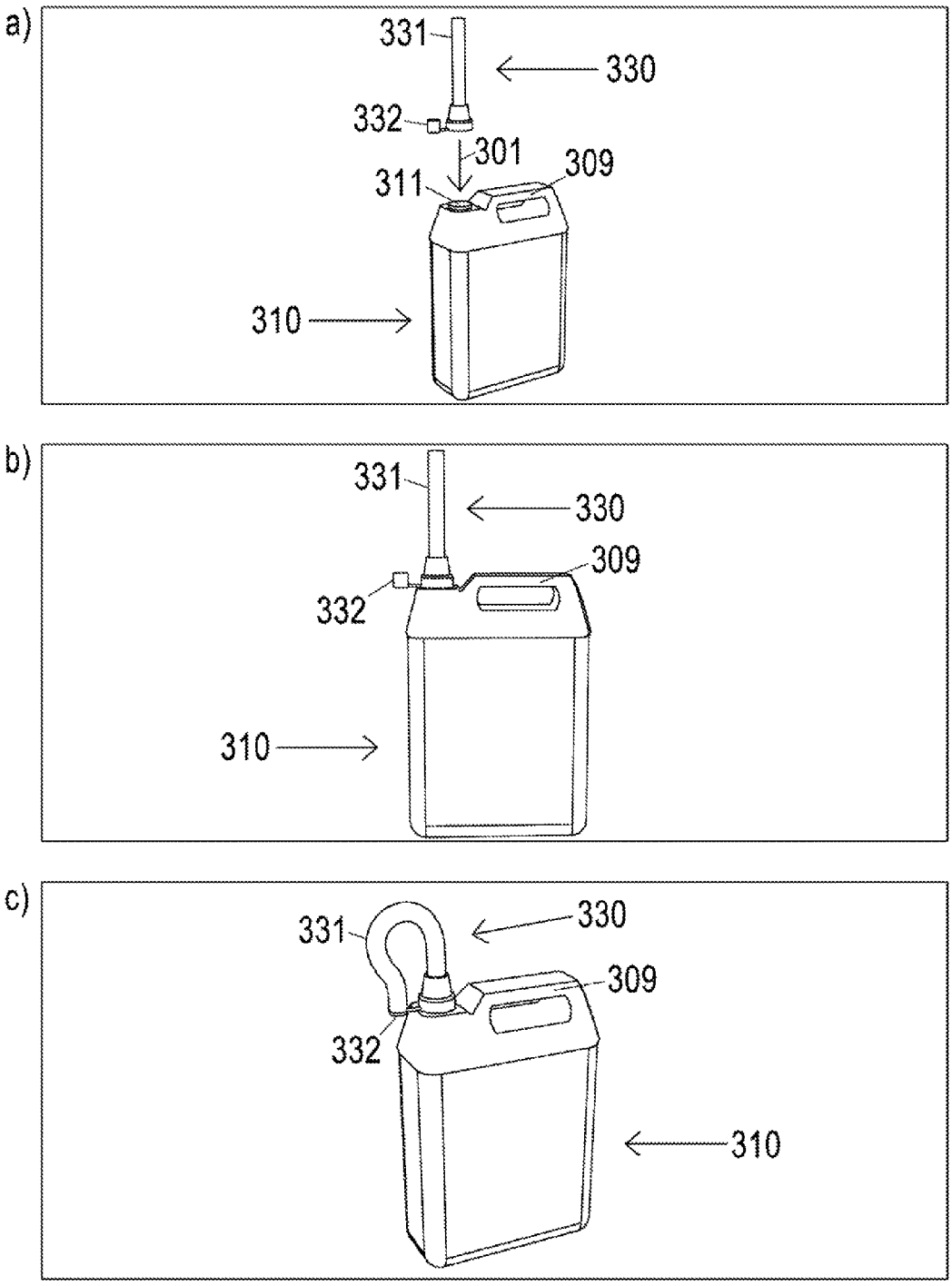
FIG. 3A illustrates the storage container sealed with a cap.
FIG. 3B illustrates the storage container with a flexible pour spout attached to the opening.
FIG. 3C illustrates the storage container with the flexible pour spout bent and engaged with the spout cap.

FIG. 3A illustrates a perspective view of the large storage container 310 before attachment of the flexible pour spout 330. The pour spout comprises a stem 331 and a spout plug 332. Motion arrow 301 indicates the attachment of the pour spout 330 to the large container opening 311. FIG. 3B illustrates an exemplary embodiment of the paint storage system in a transfer-enabled configuration. In this instance, the flexible pour spout stem 331 stands upright and open to air or other elements and the storage container 310 can be used to transfer paint via pour spout 331 to any desired location (e.g. paint tray or touch-up container as described below). FIG. 3C illustrates an exemplary embodiment of the paint storage system in a sealed configuration for storage. In this instance, the flexible pour spout stem 331 is bent downward and mated with the spout plug 332. The plug 332 is configured to fit tightly into the spout's orifice, thereby sealing the spout's opening for storage. The seal of the spout 330 by the plug 332 prevents the loss of paint from the storage container 310 and also creates an air seal that minimizes the degradation of contamination of the paint by the surrounding air and particulates (e.g. dirt, insects, etc) during storage.

Figure 4:
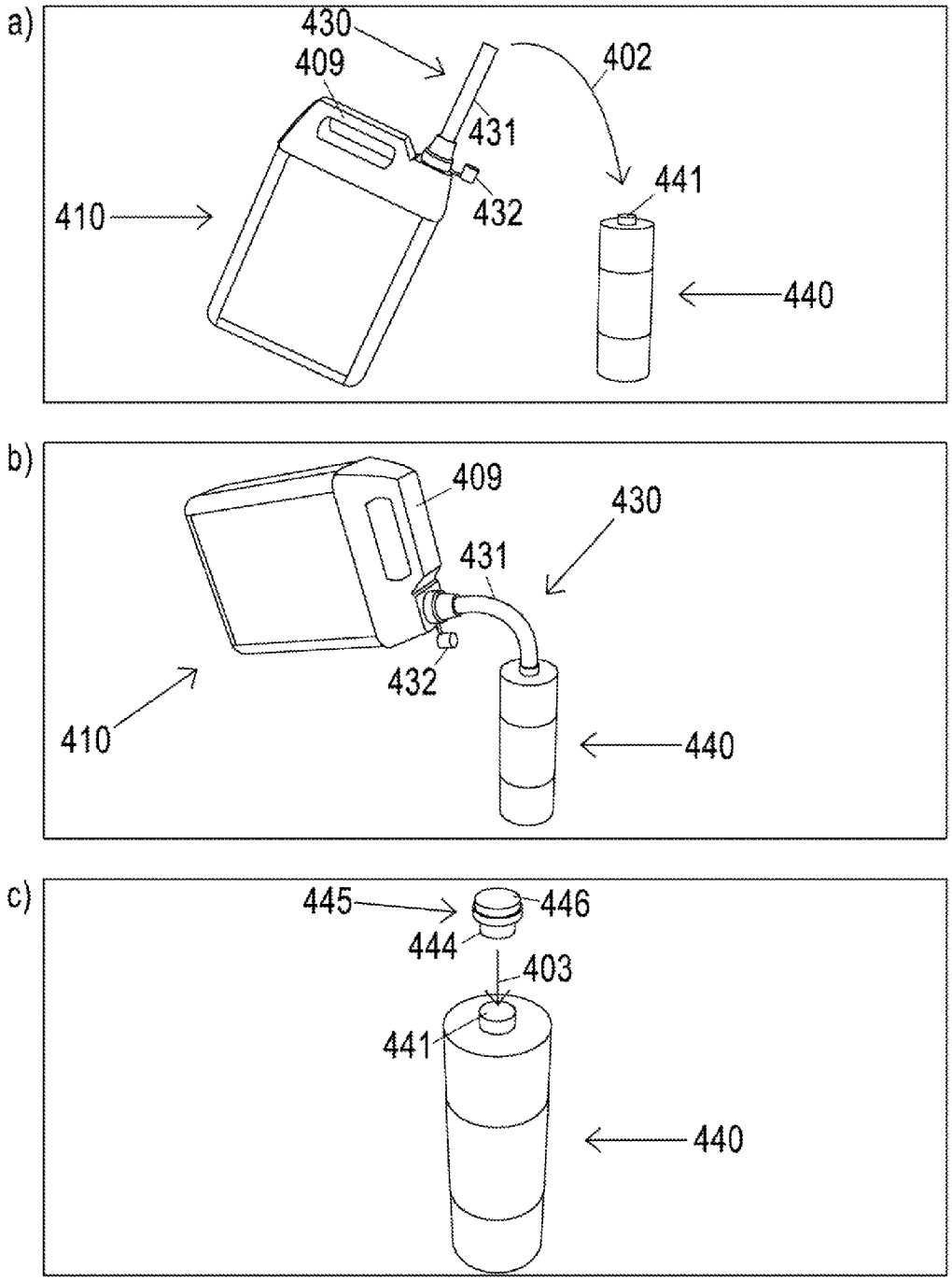
FIGS. 4A-B illustrate the storage container transferring paint to the touch-up container via the flexible pour spout.
FIG. 4C illustrates an applicator pad being affixed to the opening of the touch-up container.

FIG. 4A illustrates the process of transferring paint from the large storage container 410 to the smaller touch-up container 440 for carrying out a secondary, smaller application of paint as is commonly done in touch-up applications wherein small amounts of paint are applied to various surfaces. The large storage container 410 is shown with attached flexible pour spout 430 in a transfer-enabled position, whereby the upright pour spout may be directed via motion arrow 402 toward the smaller touch-up container's opening 441. This process is aided by grasping the large storage container handle 409. FIG. 4B illustrates a perspective view of secondary paint transfer from the large storage container 410 to the smaller touch-up container 440. The flexible pour spout 430 is now attached to the smaller touch-up container 440 via its opening 441 to provide a seal path for transferring the paint without unwanted spilling.

Figure 6:
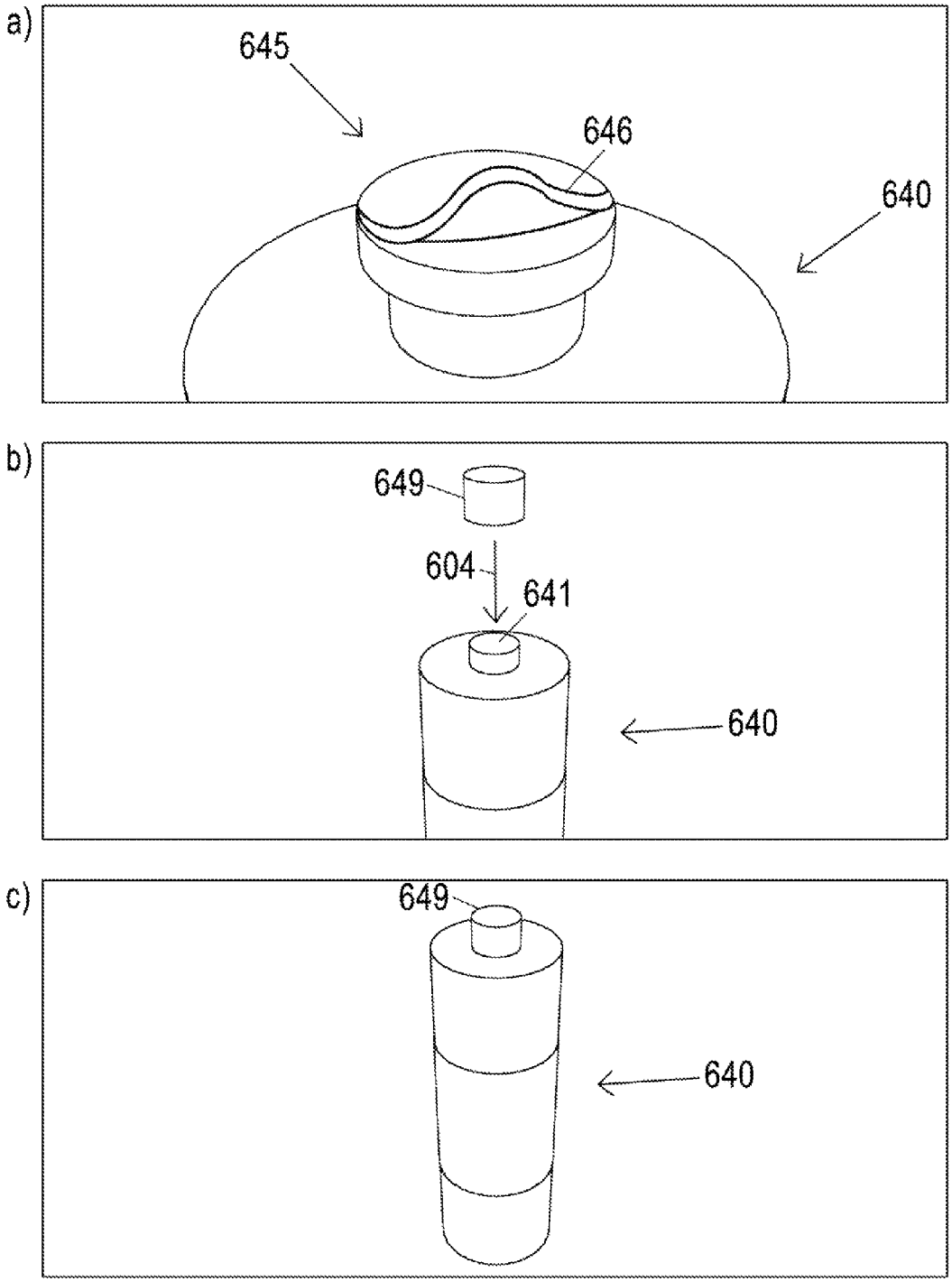
FIGS. 6A-C illustrate the replacement of the applicator pad with a cap that seals the touch-up container.

FIG. 4C illustrates a frontal view of the smaller touch-up container 440 before the attachment of a touch-up applicator 445. The touch-up applicator 445 comprises a base 444 that is configured to seal the opening 441 of the touch-up container and an applicator pad 446. The applicator base 444 can be made of a hard plastic material that is configured to seal the opening 441 via a screw-in or snap in mechanism, depending on the type of opening. Motion arrow 403 indicates the placement of the applicator 445 onto touch-up container opening 441. The applicator pad 446 can be comprised of a hard circular ring attached to a dense yet porous foam or sponge that allows the passage of small amounts of paint at a slow, controlled rate. The applicator pad 446 may be a disposable component (as described below in connection with FIG. 6) or a durable component. In the disposable embodiment, the applicator pad 446 is affixed to the base 444 via an adhesive. Once the disposable applicator pad 446 is also comprises a disposable adhesive pad 446 used up, it can be peeled off from the base 444 and replaced. Once the applicator 445 is attached, the touch-up container is now prepared for touch-up painting applications.

Figure 5:
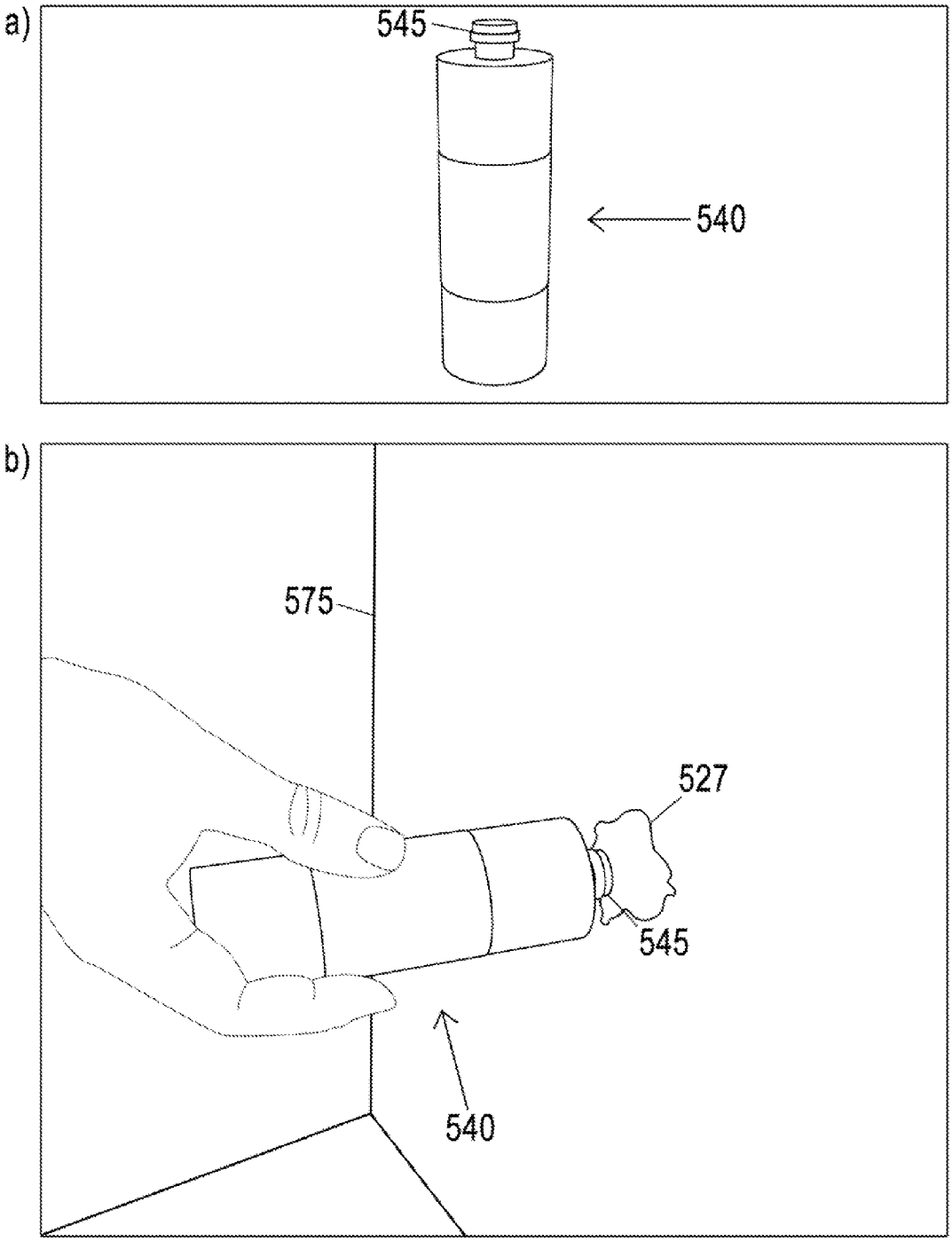
FIG. 5 illustrates the touch-up container being used to apply small amounts of paint via the applicator pad.

FIG. 5A illustrates a frontal view of a touch-up container 540 sealed by applicator pad 545. The touch-up container is now prepared to dispense paint at the discretion of the user. FIG. 5B illustrates the utilization of the touch-up container 540 for a touch-up application. The touch-up container 540 is sufficiently squeezed by the user in order to dispense the paint 527 onto the wall 575 via the applicator pad 545.

FIG. 6A illustrates a close-up view of the removal of the disposable applicator pad 646 from the touch-up applicator 645. The used adhesive pad 646 is peeled off of the applicator pad 645 and is to be disposed of as necessary. An alternate embodiment of the invention features a durable applicator pad that can be cleaned and reused. FIGS. 6B and 6C illustrate the placement of a screw-on cap 649 to seal the touch-up container 640 for storage. FIG. 6B shows this placement as it occurs via motion arrow 604, whereby the screw-on cap 649 is twisted onto the touch-up container's opening 641. FIG. 6C shows a completely sealed touch-up container 640, which prevents loss of paint from the container and also prevents the contamination or degradation of the paint by the air and outside particulates. As such, the touch-up container 640 can be storage until the next usage.

FIGS. 7A-C illustrate different views of the paint funnel 720. FIG. 7A depicts the funnel in perspective view, highlighting the two opposing curved sides, i.e. convex side 723 and concave side 724. This shape minimizes paint spillage during paint transfer from a store-bought can because convex side 723 matches the contour of the paint can and allows the paint can to get closer to and mate with the paint funnel. On the opposing side of the paint funnel, convex side 724 curves away from the funnel chamber 722 and convex side 723 that curves into the funnel chamber 722. This shape minimizes the spilling of paint during transfer by creating a funnel chamber 722 that is suited to the pouring of paint from a paint can. The top edge convex side 723, curves or arcs downward to form a recess as shown in FIG. 7B.

FIG. 7B depicts the funnel from the back, with the curved recess 723 facing toward the viewer. This further facilitates the fit between the paint can and the paint funnel. The recess provides both a space for resting and pivoting for the paint can during pouring, which further increases the ease of paint transfer and minimizes spillage. As the paint collects in funnel chamber 722, it flows through the stem 721 and into the storage container. FIG. 7C depicts the funnel in a profile view, such that the transition area 725, between the stem 121 and the wall of the funnel chamber 722, is shown. The transition area 725 provides a balance between greater paint capacity and faster flow as compared to a highly angled surface (such as with concave side 724) or a side having a ninety-degree angle. This action helps to relieve the stem 121 from a continuously large stream of paint during transfer, thereby preventing a bottleneck in flow while maintaining a high throughput.

Figure 8:
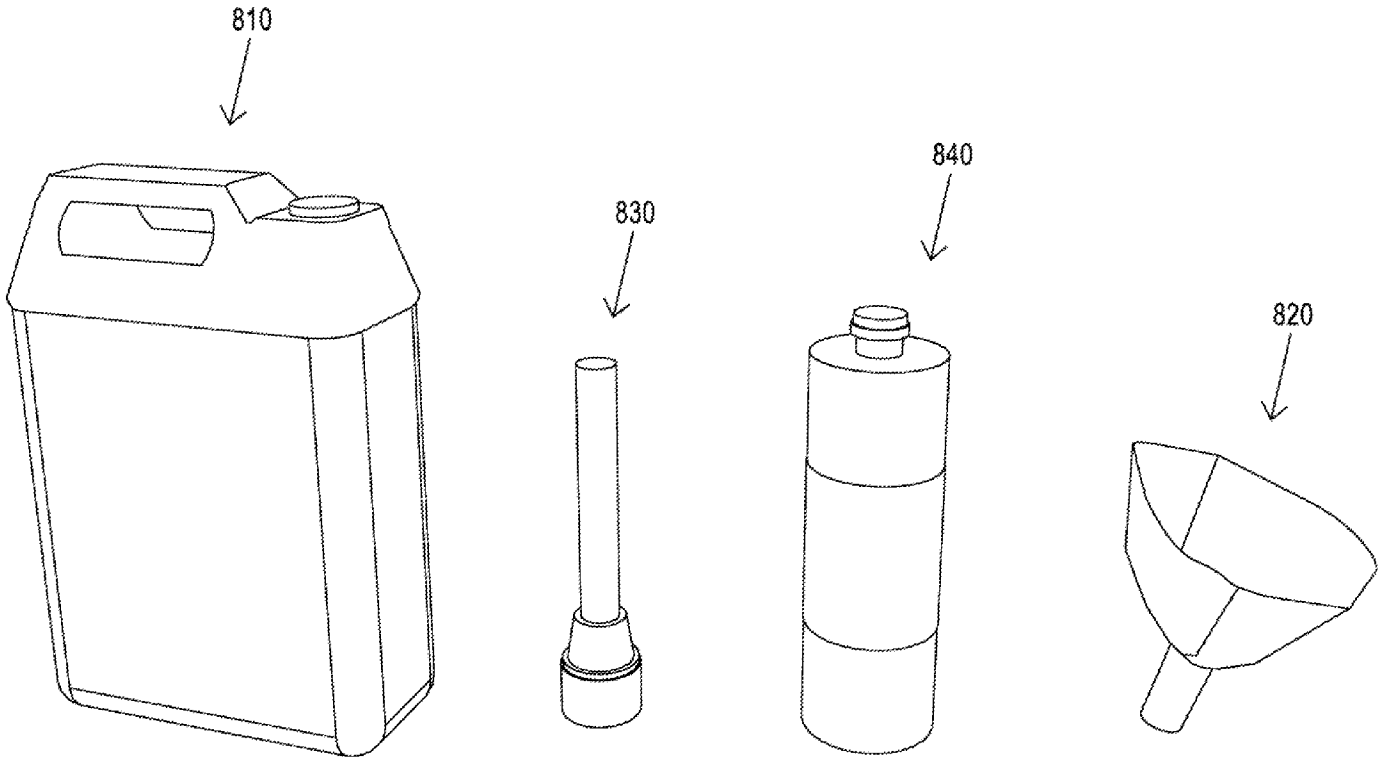
FIG. 8 depicts the components of the present invention, including the paint storage container, paint funnel, touch-up container and applicator.

FIG. 8 depicts all of the components of the present invention, including the paint storage container 810, pour spout 830, touch-up container with applicator 840 and paint funnel 820.

While there have been described herein what are considered to be preferred and exemplary embodiments of the present invention, other modifications of the invention shall be apparent to those skilled in the art from the teachings herein. For example, the relative dimensions of the device may be altered while keeping within the spirit and teachings of the invention. It is therefore desired to be secured, in the appended claims all such modifications as fall within the spirit and scope of the invention.

What is claimed is:

1. A kit for storing and dispensing paint comprising:

a storage container having an opening;

a pour spout reversibly connected with the opening of the storage container, the pour spout comprising a spout base and a flexible stem;

a funnel having an open chamber and a stem, the open chamber configured to receive paint and the stem portion configured to fit into the opening of the storage container, the open chamber having vertical and angled walls;

a touch-up container having an opening, the opening configured to receive the flexible stem of the pour spout; and an applicator reversibly attached to the opening of the touch-up container, the applicator comprising an applicator base and an applicator pad.

2. The kit of claim 1 further comprising a spout plug attached to the base of the pour spout, said plug configured to seal the pour spout.

3. The kit of claim 1 wherein the applicator pad is disposable and removable from the applicator base.

4. The applicator of claim 1 wherein the applicator base is a hard plastic cap having a perforated top portion.

5. The applicator of claim 1 wherein the applicator pad is a porous sponge or foam.

6. The kit of claim 1 wherein the funnel comprises a convex side and a concave side, the convex side opposing the concave side.

7. The funnel of claim 6 wherein the convex side of the funnel has a recessed, concave top edge.

* * * * *